US009981280B2

(12) United States Patent
Peñalver García

(10) Patent No.: US 9,981,280 B2
(45) Date of Patent: May 29, 2018

(54) PROGRAMMABLE CONCENTRIC HEAD FOR THE APPLICATION OF LIQUID TO LIDS OF DIFFERENT SHAPES

(71) Applicant: Industrias Peñalver, S.L., Murcia (ES)

(72) Inventor: José Peñalver García, Murcia (ES)

(73) Assignee: Industrias Peñalver, S.L., Murcia (ES)

( * ) Notice: Subject to any disclaimer, the term of this patent is extended or adjusted under 35 U.S.C. 154(b) by 0 days. days.

(21) Appl. No.: 15/307,404

(22) PCT Filed: Apr. 30, 2014

(86) PCT No.: PCT/ES2014/070381
§ 371 (c)(1),
(2) Date: Oct. 28, 2016

(87) PCT Pub. No.: WO2015/166115
PCT Pub. Date: Nov. 5, 2015

(65) Prior Publication Data

US 2017/0050202 A1 Feb. 23, 2017

(51) Int. Cl.

| | |
|---|---|
| ***B05C 5/02*** | (2006.01) |
| ***B05B 13/04*** | (2006.01) |
| ***B05B 7/02*** | (2006.01) |
| ***B05B 13/02*** | (2006.01) |
| *B21D 51/46* | (2006.01) |

(52) U.S. Cl.
CPC ..... *B05B 13/04* (2013.01); *B05B 7/02* (2013.01); *B05B 13/02* (2013.01); *B05C 5/0208* (2013.01); *B21D 51/46* (2013.01)

(58) Field of Classification Search
None
See application file for complete search history.

(56) References Cited

U.S. PATENT DOCUMENTS

| | | | | |
|---|---|---|---|---|
| 4,498,415 | A | 2/1985 | Tsuchiya et al. | |
| 4,798,341 | A | 1/1989 | Gimple | |
| 6,165,266 | A | 12/2000 | Garcia | |
| 9,061,308 | B2 | 6/2015 | Penalver Garcia | |
| 9,181,002 | B2 | 11/2015 | Penalver Garcia | |
| 2005/0000417 | A1* | 1/2005 | Penalver Garcia | ... B05C 5/0212 118/323 |

(Continued)

FOREIGN PATENT DOCUMENTS

| | | | |
|---|---|---|---|
| EP | 0933134 | A2 | 8/1999 |
| EP | 2653235 | A1 | 10/2013 |

(Continued)

*Primary Examiner* — Jethro M Pence
(74) *Attorney, Agent, or Firm* — The Webb Law Firm

(57) ABSTRACT

A device for the application of a liquid fluid to a peripheral area of a lid using pistols for injecting said liquid fluid. The device includes an articulated mechanical device combined with at least two coaxial tubular shafts: a main supply shaft and a lower shaft, where a lower end of the main supply shaft connects to a first part of the articulated mechanical device, while a second part of the articulated mechanical device connects to a lower end of the lower shaft. The two coaxial tubular shafts rotate independently by means of transmission devices. The main supply shaft is arranged in an inner hole of the lower shaft, which is arranged coaxially around at least one section of the main supply shaft.

16 Claims, 11 Drawing Sheets

(56) References Cited

U.S. PATENT DOCUMENTS

| | | | | |
|---|---|---|---|---|
| 2005/0124672 | A1* | 6/2005 | Naganawa | C07D 213/70<br>514/365 |
| 2013/0062431 | A1* | 3/2013 | Penalver Garcia | B05B 13/0421<br>239/140 |
| 2013/0333614 | A1* | 12/2013 | Penalver Garcia | B05B 13/0221<br>118/313 |

FOREIGN PATENT DOCUMENTS

| | | | |
|---|---|---|---|
| ES | 2381348 | A1 | 5/2012 |
| ES | 2396845 | A1 | 2/2013 |

* cited by examiner

PROGRAMMABLE CONCENTRIC HEAD FOR THE APPLICATION OF LIQUID TO LIDS OF DIFFERENT SHAPES

CROSS-REFERENCE TO RELATED APPLICATION

This application is the United States national phase of International Application No. PCT/ES2014/070381 filed Apr. 30, 2014, the disclosure of which is hereby incorporated in its entirety by reference.

BACKGROUND OF THE INVENTION

Field of the Invention

The present invention relates to a programmable concentric head for the application of liquid to lids of different shapes, which includes mainly circular-shaped lids and of certain shape, and that performs the application with all types of lid geometries. Since among all of the functionalities provided by the head, the application of liquids to lids is one of the most required, this will be the one described in the present invention without thereby excluding the rest of the applications mentioned below.

The programmable concentric head for the application of liquid to lids of different shapes is capable of applying liquid material in lids of circular geometries and of certain shapes: square, rectangular and oval, among others, and it applies it with formats with a diagonal ranging between 62 mm and 314 mm, which includes almost all the lids available in the market, at a maximum speed of 250 lids per minute.

The concentric head of the invention is provided in a single unit, is highly durable, requires minimum space, is extremely productive, requires minimum maintenance, is capable of simply and easily exchanging different lid formats, is easily adapted to machines owned by the proprietor of the invention in question, and even to machines made by other manufacturers, is capable of sealing/repairing circular lids and of certain shapes at least with an injecting pistol for application within the vast range of previously mentioned sizes and which may supply substantially all types of lids currently available in the market and is capable of performing different functions, such as rubberising/varnishing, as well as those analogous to a pantograph or plotter to make strokes and/or sign-writing, given its multi-purpose nature and versatile design.

Description of Related Art

Currently, there are several systems available for the application of liquids aimed at sealing/repairing lids, but we are not aware of any providing the features of the present invention.

For example, Spanish patent applications P 201031569 and P 201031868 are known in the art, both owned by the proprietor of the present invention and both of which refer to heads for re-varnishing lids.

SUMMARY OF THE INVENTION

The programmable concentric head for application to lids of different shapes, which is the object of the invention, is intended for applying a liquid fluid to a peripheral area of a lid by means of pistols for injecting said liquid substance, wherein said injecting pistols are related to movable mechanisms that drag the injecting pistols through said peripheral area of the lid, wherein said movable mechanisms are included in a device for applying liquids supported onto a movable base support that is part of a lifting device of the head.

There may be one or more than one injecting pistols.

The movable mechanisms comprise an articulated mechanical device combined with two axial tubular shafts: a main supply shaft and a lower shaft; wherein a lower end of the main supply shaft is connected to a first part of the articulated mechanical device, while a second part of the articulated mechanical device is connected to a lower end of the lower shaft.

The two coaxial tubular shafts rotate independently via transmission devices, while the main supply shaft is arranged in the inner hole of the lower shaft, which is arranged coaxially around at least one section of the main supply shaft.

The articulated mechanical device comprises a lower rod-holder crossbar combined with an upper rod-holder crossbar, wherein the diametrically opposed ends of each crossbar are connected in an articulated manner by pairs of rods: first and second.

Ends of the first rods are connected to the ends of the lower rod-holder crossbar, while some ends of the second rods are connected to the ends of the upper rod-holder crossbar.

Common ends of the first and second rods are coupled to each other via articulated connections, the injecting pistols being arranged in correspondence therewith.

The lower rod-holder crossbar is fixed through its centre to the main supply shaft, while the upper rod-holder crossbar is fixed through its centre to the lower shaft. Both crossbars are arranged in different parallel planes, which are perpendicular to the direction of both coaxial tubular shafts.

The articulated connections of the rods with their related rod-holder crossbars comprise screws fixed to the rods, being coupled around said screws some bearings which are spaced by means of separating bushings, wherein the screws rigidly rotate with the inner track of the bearings at the same time that the outer tracks of the latter are coupled to the crossbar mortises, and wherein the two rods and their related rigidly secured screws rotate as a block with respect to the diametrically opposed ends of the rod-holder crossbars.

The common ends of the articulated connection of the first and second rods create housings, each of them having a friction bushing press-fitted onto the first rod and a self-lubricated bronze bushing press-fitted onto the inner diameter of the second rod, wherein with this arrangement the bronze bushing rotates around the friction bushing, thus allowing the rotation between each pair of rods through their articulated connection. The injecting pistols are fixed to the first rods.

In an embodiment, the device for the application of liquids includes two transmissions related to two servomotors: front and rear. The front servomotor transmits its movement to an upper shaft of tubular structure, which is arranged in the same axial direction as the lower shaft and above the latter. By contrast, the rear servomotor transmits its movement to the lower shaft.

The supply of pressure air and liquid fluid to the pneumatically-actuated injecting pistols is carried out by means of the main supply shaft, which rotates jointly with the upper shaft since it is screwed thereto.

The transmissions are composed of two belts: front and rear; two driving pulleys: front and rear; and two driven pulleys: front and rear.

As regards the transmission actuated by the front servomotor, a front driven pulley rotates rigidly secured to the upper shaft of tubular structure, since it is coupled to the inner diameter of a front driven pulley and fixed thereto by means of a conical bushing and castellated nut; the upper shaft rotating jointly onto the inner tracks of two ball bearings which are coupled onto a common mortise located on a rear bearing support.

As regards the transmission driven by the rear servomotor, the rear driven pulley rotates rigidly secured to the lower shaft since it is coupled to the inner diameter of a rear driven pulley and fixed thereto by means of a conical bushing and castellated nut; the lower shaft rotating jointly onto the inner tracks of two ball bearings which are coupled onto a common mortise located on a bearing support.

Symmetrically, the front and rear supports are screwed by means of four screws fixing both bodies onto the base support of the head.

The main supply shaft is coupled onto a flange of the upper shaft and throughout its inner diameter, which constitutes the means to supply pressure air and liquid fluid to the pneumatically-actuated injecting pistols; wherein said main supply shaft rotates jointly with the upper shaft since it is screwed thereto.

The head also comprises a first rotating joint to supply pressure air and a second rotating joint for the passing of liquid fluid; such that the first rotating joint comprises two air passageways and is basically composed of two cylindrical bodies: one upper body and one lower body, screwed therebetween, while including different elements to provide rotation capacity and airtightness.

The lower body contains two inlets defined by two threaded bores for the pressure air inlets aimed at handling the opening/closure of the pneumatically-actuated injecting pistols.

The second rotating joint directs the liquid fluid towards the injecting pistols; for this purpose it comprises a passageway, being also composed of two cylindrical bodies: one upper body and one lower body, screwed therebetween, while housing different elements to provide said second rotating joint with rotation capacity and airtightness.

The pressure air passes from the two inlets of the lower body towards two separating bushings and two friction bushings respectively drilled, to connect with two bores that have been arranged on a first tubular shaft and that connect to two tubes both coupled around the main supply shaft, thus extending both ducts towards the lower end thereof, right where the first part of the articulated mechanical device is assembled to transfer the pressure air through several sleeves towards the injecting pistols.

The airtightness of the two chambers housed inside the first rotating joint for the passing of air includes four retainers arranged in pairs and separated by two separating bushings; wherein the rotation of the rotating joint is transmitted by the main supply shaft via the press-fitting performed between the outer diameter of the latter upon coupling with the inner diameter of the tubular shaft; the main supply shaft rotating jointly with the tubular shaft and, in turn, both rotating with the inner tracks of the two ball bearings onto which the first tubular shaft is likewise press-fitted.

The outer tracks of the ball bearings are press-fitted onto a common mortise created between the two lower and upper bodies and with the peculiarity that, in order to make the assembly of the first rotating joint more compact, the upper bearing has been arranged fitted onto both bodies.

The upper body of the second rotating joint is provided with a threaded bore in the upper area to feed the liquid fluid onto an upper chamber provided; housing therein a ceramic tube as passageway of said fluid and connecting with a coupling fixed through a castellated nut, threading said coupling onto the upper end of the main supply shaft; wherein through its inner bore the passing of liquid fluid is facilitated towards the lower end where the first part of the articulated mechanical device is fixed for transferring the liquid material through some sleeves towards the injecting pistols.

The airtightness of the different chambers of the second rotating joint is obtained by including three retainers, one intended for making the upper chamber hermetic and two for isolating the second lower chamber composed of four bores at 90°, intended for drainage and refrigeration.

The rotation of the second rotating joint is transmitted by the main supply shaft by means of a coupling, which rotates jointly with the ceramic tube and the inner track of the ball bearing, being the outer track of the latter press-fitted onto the inner diameter of the cylindrical bodies: upper and lower.

A first separating bushing is arranged onto this second rotating joint to define the cavity created in a drainage chamber between the retainers, and also a second separating bushing the function of which is to enable a chamber created between the lowest retainer and the ball bearing to house the castellated nut, which is in charge of fixing the second rotating joint to the main supply shaft through the coupling it blocks.

The lifting device comprises a main fixed support wherein a pneumatic cylinder is coupled, to the stem of which the base support that sustains the assembly of the device for the application of liquid is joined, the base support being joined to a head-holder support.

The head-holder support includes two slots where two linear guides are screwed; the linear guides are connected to linear bearings, which remain fixed onto two mortises provided in the main fixed support.

The height of the base support may be adjusted in its connection to the stem of the pneumatic cylinder; having anticipated for such purpose a stem support fixed to the base support and in the interior of which the stem of the pneumatic cylinder is housed, which in turn has been extended having an extender bushing provided with two flat sides.

BRIEF DESCRIPTION OF THE DRAWINGS

To supplement the present description and in order to give a better understanding of the characteristics of the invention, this descriptive report is accompanied by a series of plans, which are an integral part of the invention, for illustration purposes and without limitation. For such purpose, the following views have been represented.

DESCRIPTION OF THE INVENTION

Figure 1:
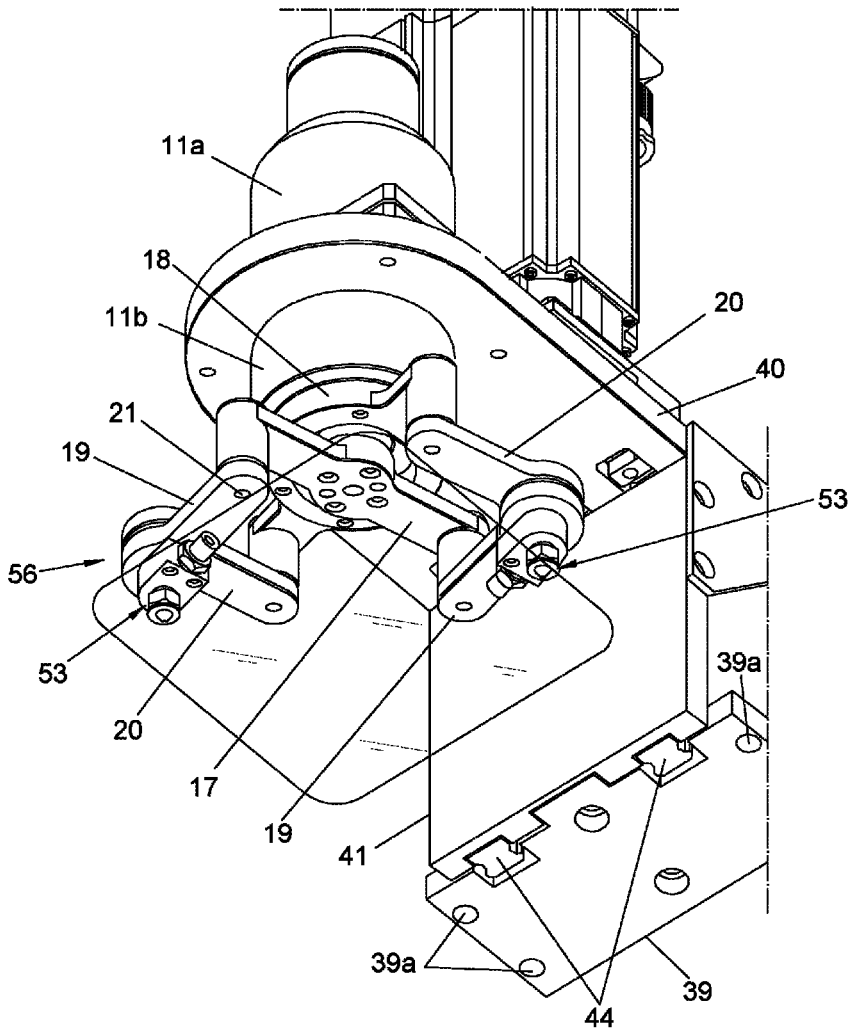
FIG. 1 shows a perspective view of the programmable concentric head for the application of liquids to lids of different shapes, which is the object of the invention. In principle, it comprises a device for the application of a liquid fluid and a lifting device.
Figure 1A:
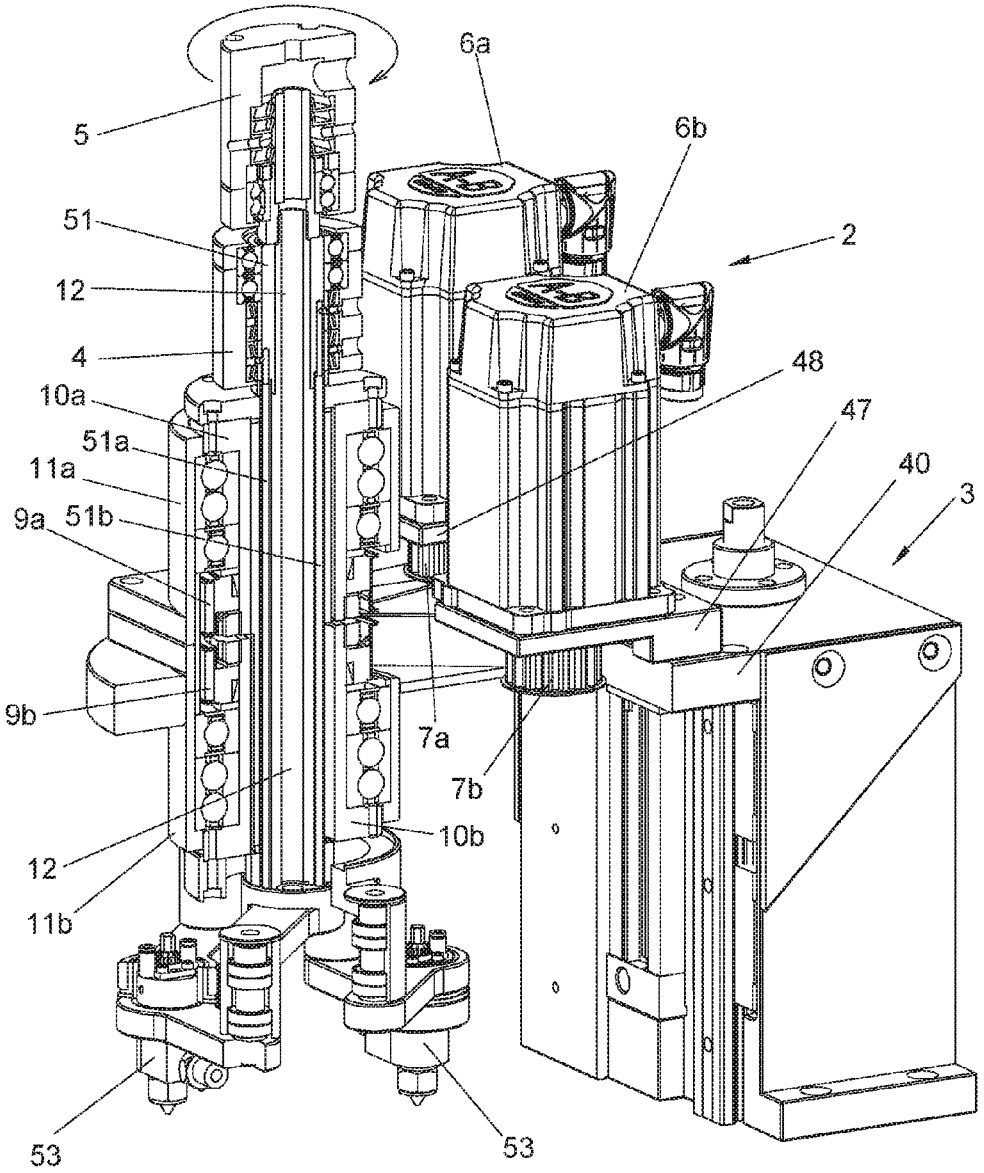
FIG. 1A represents a general perspective view of the concentric head of different shapes with a first option, wherein the transmission of movement is carried out by means of servomotors, displaying the main elements.
Figure 1B:
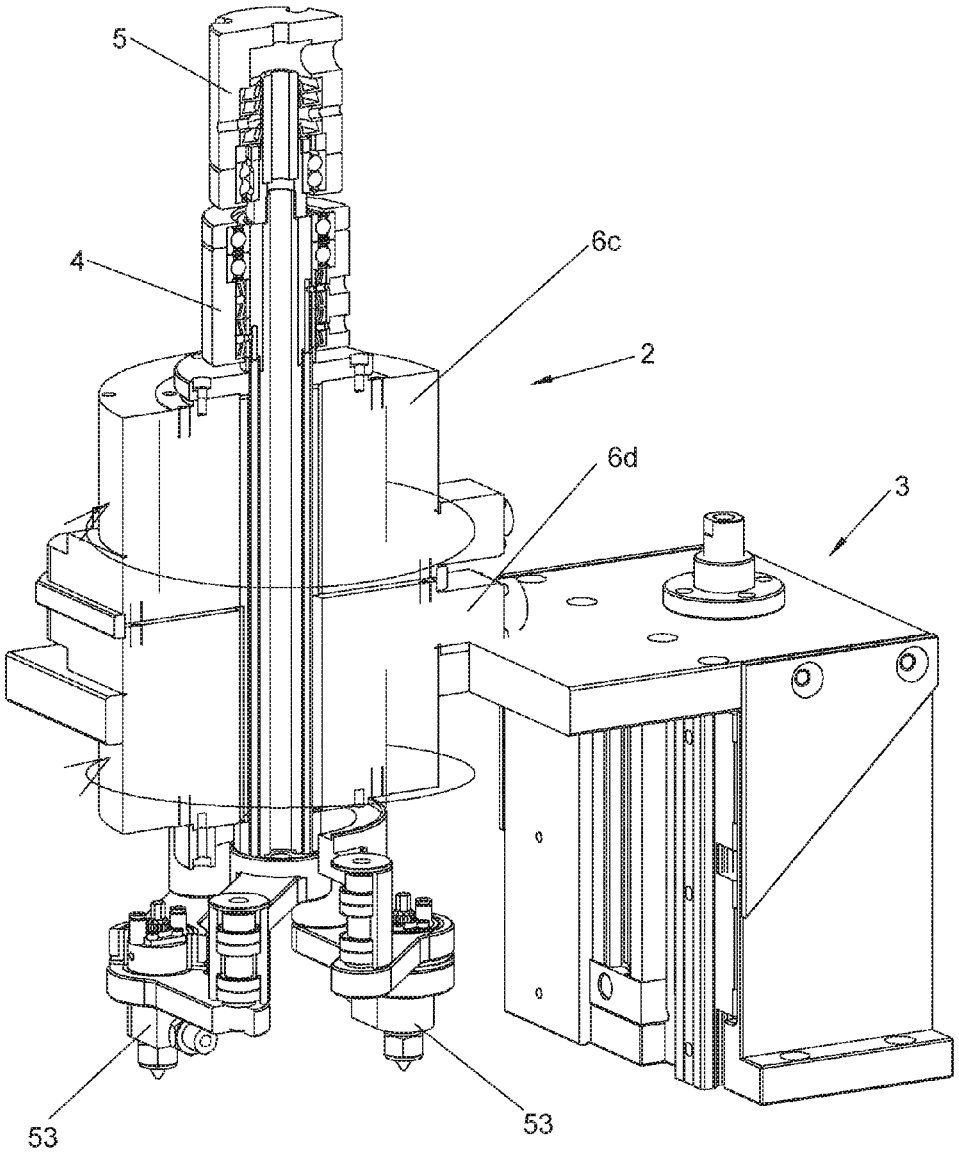
FIG. 1B represents a general perspective view of the concentric head of different shapes with a second option, wherein the transmission of movement is carried out by means of direct-drive motors. The rotation direction of the transmission providing movement to the head is also appreciated.
Figure 2:
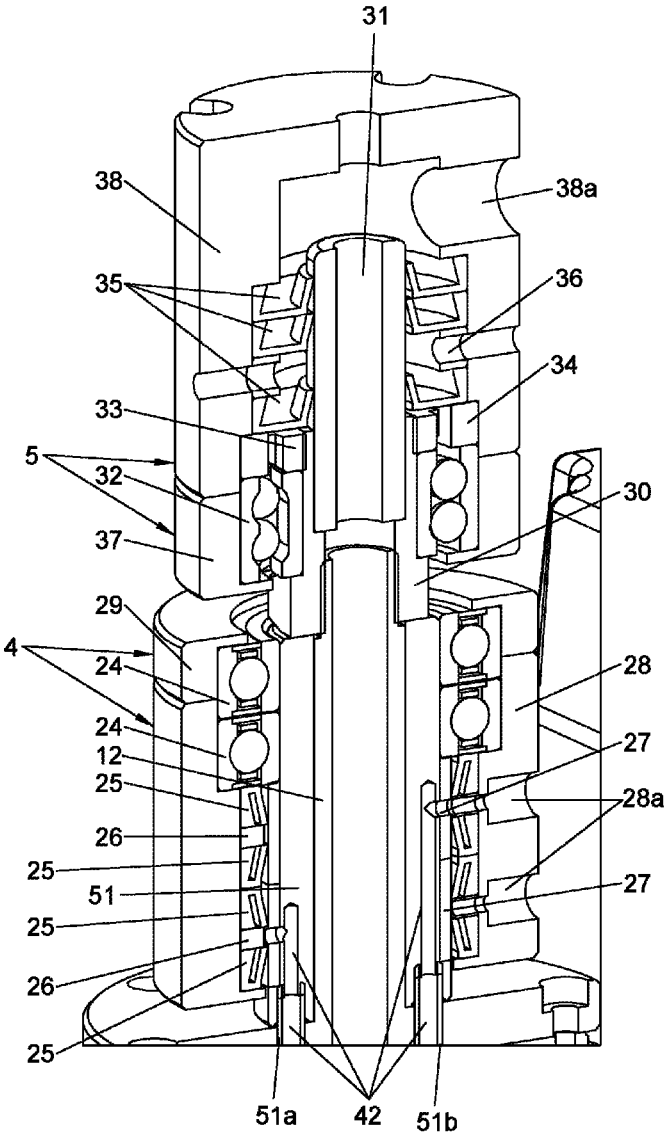
FIG. 2 shows a detailed cross-section of some rotating joints for air and liquid fluid which are part of the concentric head.
Figure 3:
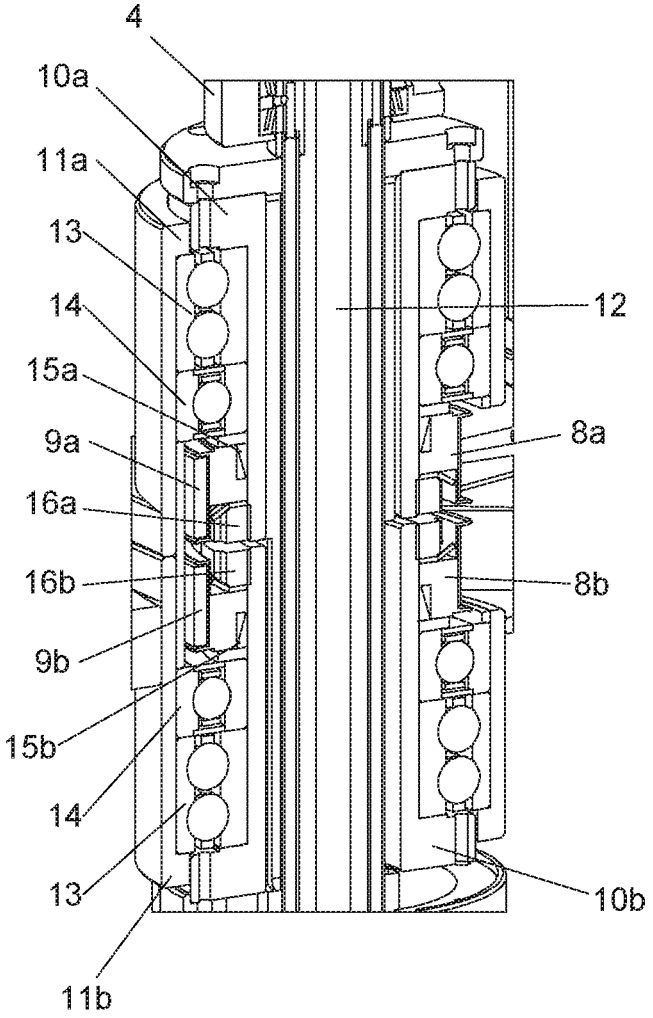
FIG. 3 shows a sectional view of one of the parts of the head of the invention.
Figure 4A:
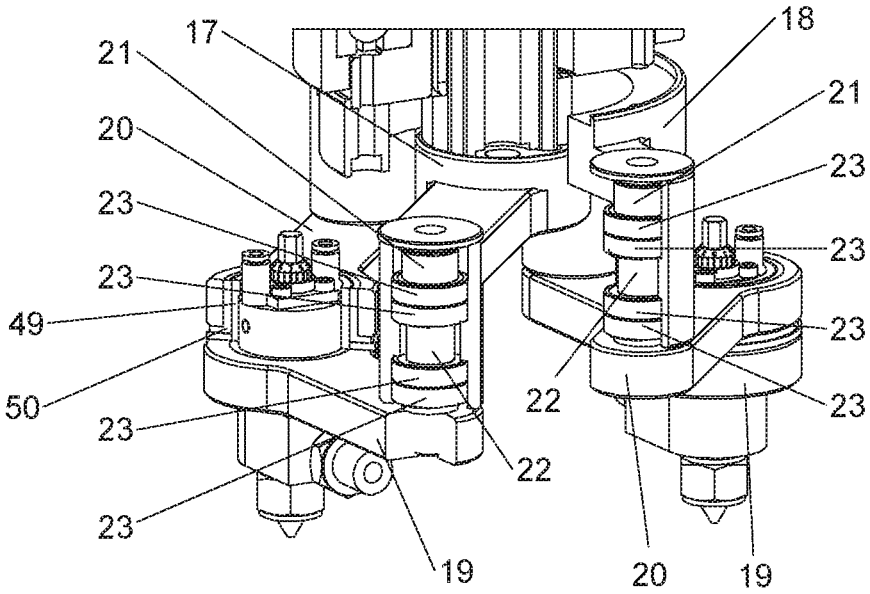
FIG. 4A represents a sectional perspective view essentially showing a characteristic articulated device to carry out the application of liquid.
Figure 4B:
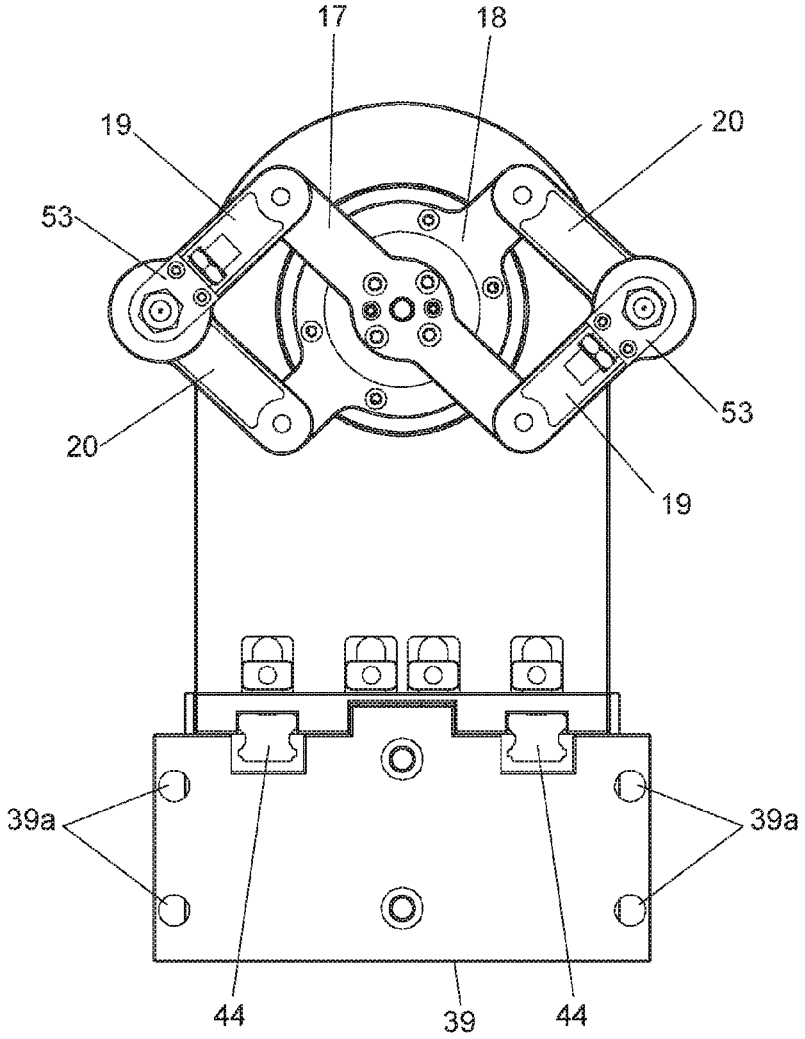
FIG. 4B shows a plan view of what was represented in the previous figure.
Figure 5:
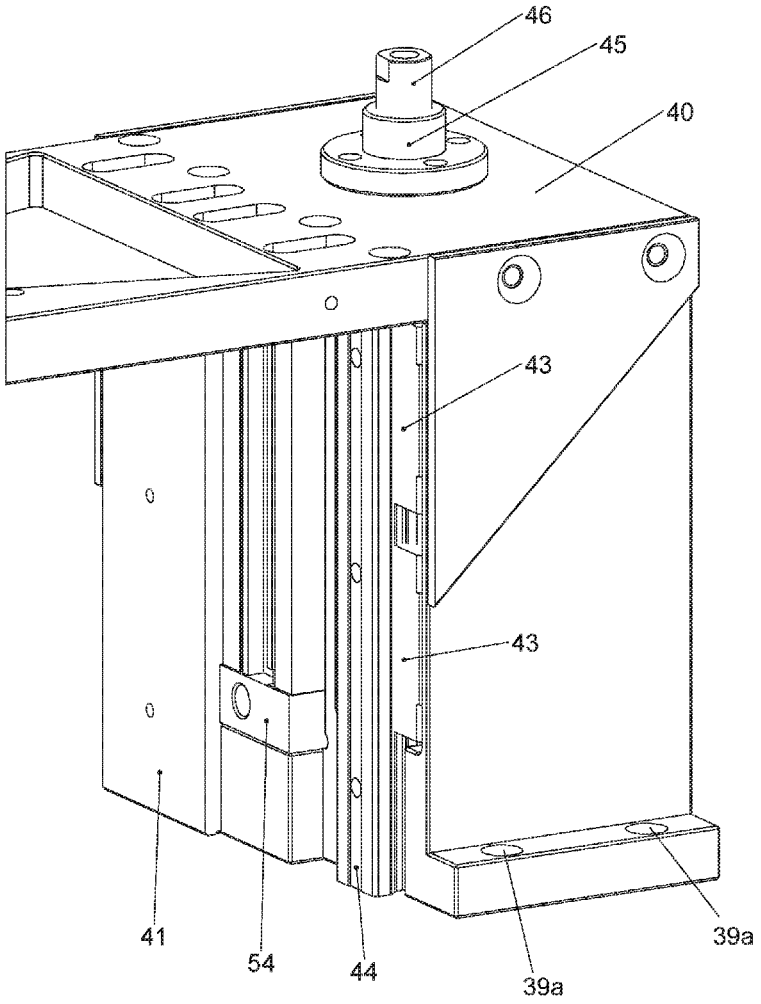
FIG. 5 represents a perspective view of the lifting device.
Figure 6:
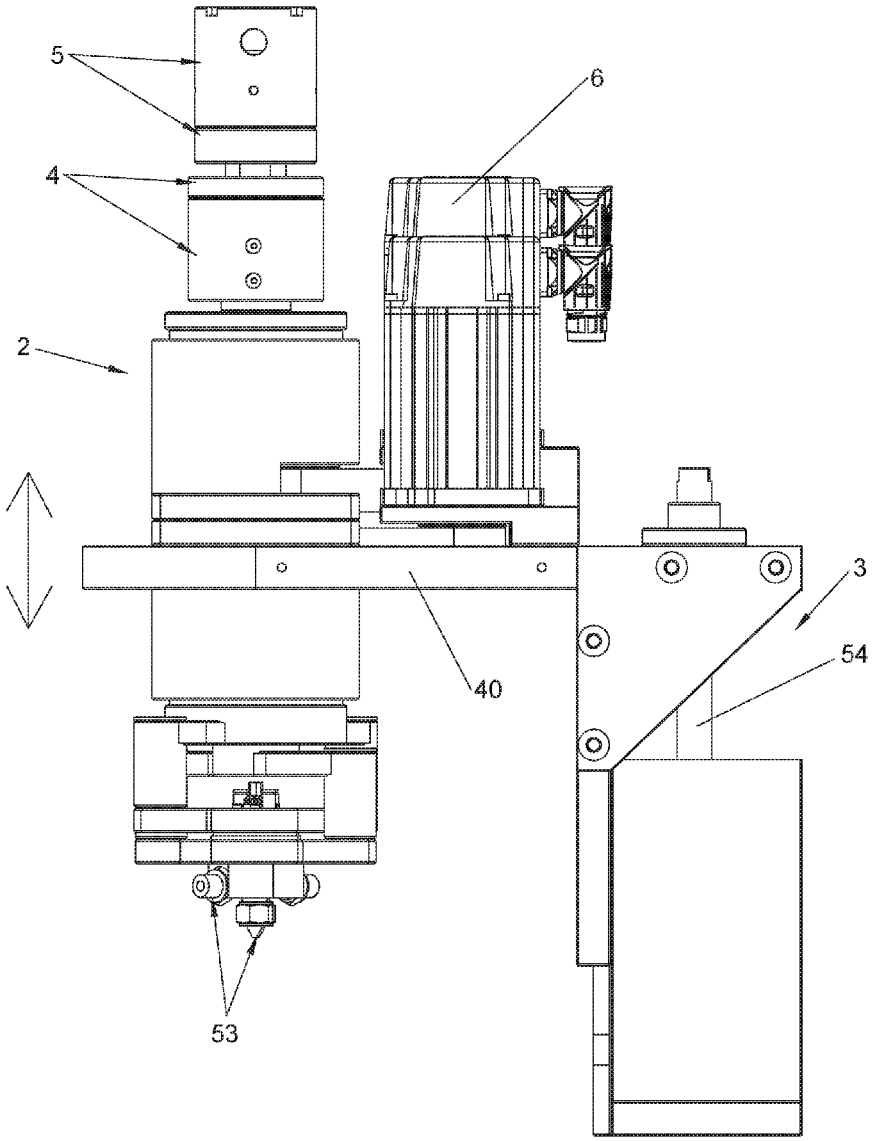
FIG. 6 shows an elevation view of the lifted position adopted by the head for the application of liquid, a position which is achieved by means of the lifting device.
Figure 7:
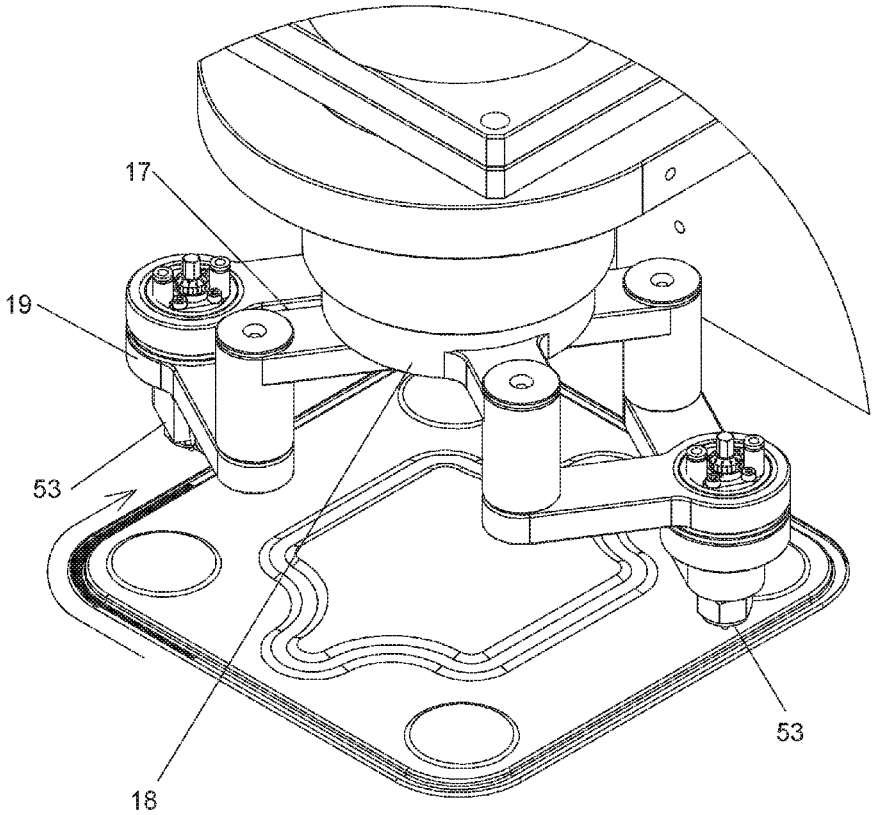
FIG. 7 represents a perspective view of the process for applying a liquid material onto the lid.
Figure 8:
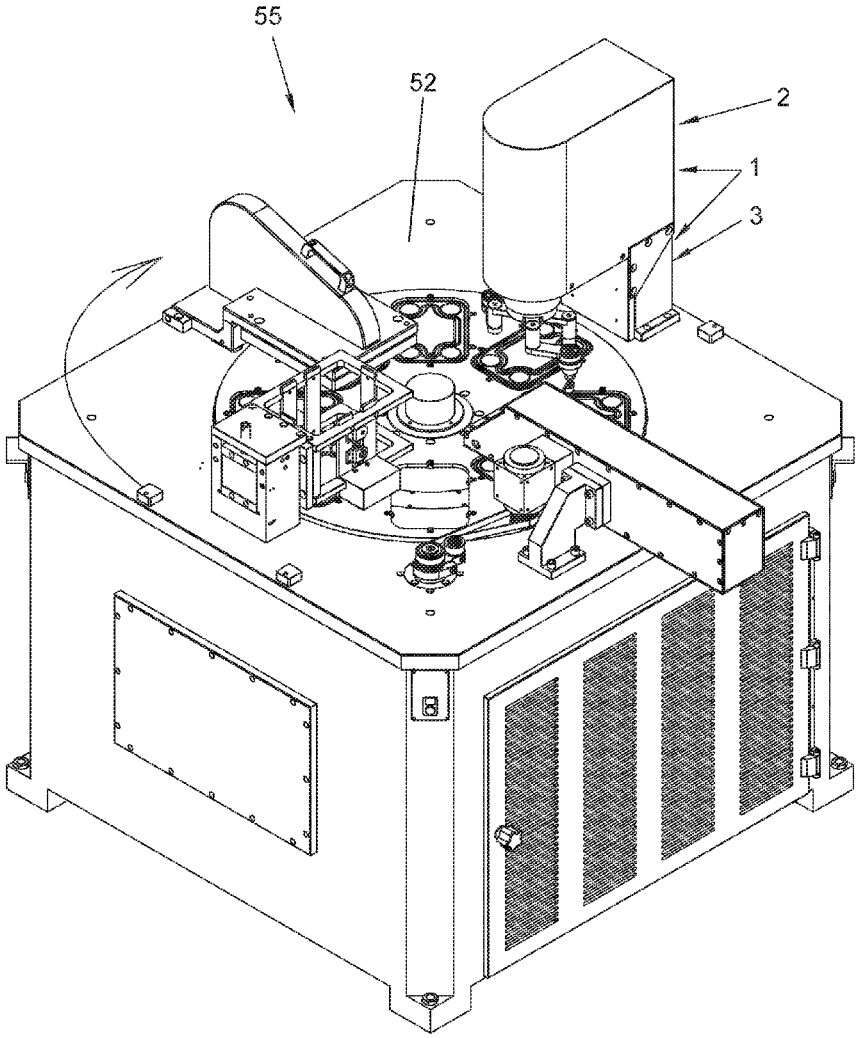
FIG. 8 shows a perspective view of the machine including the head of the invention.

In view of what was previously described and taking into account the numbering adopted in the figures, the invention is focused on a programmable concentric head for the application of liquid to lids of different shaped that may be integrated to newly manufactured or existing machines, being capable of adapting to any geometry with a quick and easy change in format, consisting in pre-selecting the servomotor/direct-drive motor software of the new geometric profile of the lid to be sealed/repaired.

As it has been previously mentioned, the concentric head of different shapes (1) is basically composed of two devices, the one designed for the application of liquid (2) and the one for lifting (3). Below is a description of their operations, as well as the parts composing each one of them.

It refers to a concentric head of different shapes with prismatic geometry and includes the two options of being driven by two servomotors (6*a*), (6*b*) or else by two direct-drive motors (6*c*), (6*d*). The first description corresponds to the first option, by means of servomotors (6*a*), (6*b*), since its mechanism comprises a greater number of elements, most of which are common to the second option, by means of direct-drive motors (6*c*), (6*d*), which will be described further on.

The device for the application of liquid (2) is supported onto a movable head base support (40) that is part of the lifting device (3), and in turn functions as a link between both devices (2), (3). Onto the base support (40) of the head two servomotor supports are screwed: front (47) and rear (48) with different heights for coupling the servomotors (6*a*), (6*b*), the base support (40) presenting rails to regulate the supports (47), (48) in order to provide the optimum tension to both transmissions.

The device for the application of liquid (2) is provided with two transmissions, one for each servomotor (6*a*), (6*b*), composed of two belts: front (9*a*) and rear (9*b*); two driving pulleys: front (7*a*) and rear (7*b*); and two driven pulleys: front (8*a*) and rear (8*b*). As regards the transmission of the servomotor (6*a*), a front driven pulley (8*a*) rotates rigidly secured to an upper shaft (10*a*) of tubular structure, since it is coupled to the inner diameter of the driven pulley (8*a*) and fixed thereto by means of a conical bushing (15*a*) and castellated nut (16*a*). In addition, the upper shaft (10*a*) rotates jointly onto the inner tracks of two ball bearings (13), (14), which are coupled onto a common mortise located on a front bearing support (11*a*).

Symmetrically, the device for the application of liquids (2) is composed of a rear bearing support (11*b*) intended for an analogous function for the assembly of a lower shaft (10*b*), such that both supports (11*a*), (11*b*) are screwed by means of four screws that fix both bodies to the base support (40) of the head. Onto a flange of the upper shaft (10*a*) and throughout its inner diameter a main supply shaft (12) is coupled, also with tubular structure, the function of which, among others, is to supply pressure air and liquid fluid to the pneumatically-actuated injecting pistols (53). Said main supply shaft (12) rotates jointly with the upper shaft (10*a*) since it is screwed thereto.

Onto the lower end of the main supply shaft (12), which protrudes from underneath the lower shaft (10*b*), a lower rod-holder crossbar (17) is coupled and fixed by means of screws, which rotates jointly with the main supply shaft (12). Two first rods (19) capable of rotation are articulated on diametrically opposed ends of said lower rod-holder crossbar (17).

The first rods (19) have been provided with free rotation right on the threaded end and where it is assembled with the lower rod-holder crossbar (17) by including a screw (21) onto which four ball bearings (23) are coupled, located throughout said screw (21), in pairs, these pairs of bearings (23) being spaced apart by means of a separating bushing (22) to provide an exact fit, and which threads said screw (21) onto the first rod (19) through its end.

The screw (21) rotates jointly with the inner track of the ball bearings (23) at the same time that the outer track of the latter is coupled to the inner diameter of a mortise of the lower rod-holder crossbar (17), such that the first rod (19) and screw (21) rotate in a block as a unique body with respect to the diametrically opposed ends of the lower rod-holder crossbar (17).

As regards the second transmission, which is driven by the servomotor (6*b*), the rear driven pulley (8*b*) rotates rigidly secured to the lower shaft (10*b*), since the lower shaft (10*b*) is coupled to the inner diameter of the rear driven pulley (8*b*) and fixed thereto by means of a conical bushing (15*b*) and a castellated nut (16*b*). In addition, the lower shaft (10*b*) rotates jointly onto the inner tracks of two ball bearings (13), (14), which are coupled onto a common mortise located on the rear bearing support (11*b*).

An upper rod-holder crossbar (18), which rotates jointly with said lower end (10*b*), is coupled and fixed by means of screws onto a flange of the lower end (10*b*). Likewise, two second rods (20) capable of rotating each of them on each of the ends thereof, are articulated in diametrically opposed ends of the upper rod-holder crossbar (18). The second rods (20) have been provided with free rotation, as its equivalent first rods (19), the same rotation mechanism being designed by means of the bearing assembly (23), separating bushing (22) and screw (21), all of them mentioned above; thus achieving that each second rod (20) and screw (21) rotate in block as a unique body with respect to the diametrically opposed ends of the upper rod-holder crossbar (18).

With this arrangement, the four rods (19-20) coupled in pairs onto two different horizontal planes defined by the lower (17) and upper (18) rod-holder crossbars, respectively, are coupled evenly with respect to each other for the rods to create a housing for the pneumatically-actuated injecting pistols (53).

Each pair of rods (19), (20) articulated to each other is composed of a first rod (19) assembled onto the lower rod-holder crossbar (17) and a second rod (20) assembled onto the upper rod-holder crossbar (18).

Onto the common housing created between each pair of rods (19), (20), a friction bushing (49) is press-fitted to the first rod (19) and a self-lubricated bronze bushing (50) press-fitted onto the inner diameter of the second rod (20), such that, with this arrangement, the bronze bushing (50) rotates around the friction bushing (49), thus allowing rotation between each pair of rods (19), (20) through their articulated connection, and since each pneumatic injecting pistol (53) is screwed to the first rod (19), it jointly moves along with its movement.

The assembly composed by the rod-holder crossbars: upper and lower (17-18), and the four rods (19-20), comprise a scissor-like articulated mechanical device provided with two coaxial independent rotation shafts and six articulations, with the peculiarity that two of them coincide with the exact position for the application of liquid and which is, ultimately, where each injecting pistol (53) remains positioned to perform said application.

In addition, the main difference in design found in the concentric head (1) of different shapes concerning the coupling of the two direct-drive motors (6*c*), (6*d*) with respect to the servomotors (6*a*), (6*b*) is that the two shafts providing rotation to the upper (18) and lower (17) rod-holder crossbars are now the lower shaft (10*b*) and the main supply shaft (12), respectively, the upper shaft (10*a*), which was used with the servomotor option (6*a*), (6*b*), being eliminated from the design.

The main supply shaft (12) is directly driven by the motor (6*c*) while the lower shaft (10*b*), likewise coupled in a direct manner, is driven by the motor (6*d*). The rest of the components participating in the mechanism for conducting the application of liquid are exactly as described herein when using the option of transmission by means of two servomotors (6*a*), (6*b*).

To handle the actuation of the injecting pistol (53), as well as to supply it with the injected material, two rotating joints have been designed: a first joint (4) for the passing of air and a second joint (5) for the passing of liquid fluid, respectively, which will be described below.

The first rotating joint (4) has been designed to supply pressure air while handling the opening/closure of the injecting pistol/s (53). It is a first rotating joint (4) with two air passageways and is basically composed of two cylindrical bodies, one upper body (29) and another lower body (28), screwed therebetween, while including different elements to provide rotation capacity and airtightness. The lower body (28) contains two inlets defined by two threaded bores (28*a*) for the pressure air inlets aimed at handling the opening/closure of the pneumatically-actuated injecting pistol/s (53).

The passing of fluid is carried out from the two inlets of the lower body (28) towards two separating bushings (26) and two friction bushings (27) respectively drilled, to thus connect with two ducts (42) onto which two tubes (51*a*) and (51*b*) have been placed, both coupled around the main supply shaft (12), thus extending both ducts towards the lower end thereof, right where it is assembled with the lower rod-holder crossbar (17) and, through two connecting couplings located therein, pressure air is supplied by means of two sleeves towards the injecting pistols (53).

The airtightness of the two chambers generated inside the first rotating joint (4) for the passing of air has been achieved including four retainers (25) arranged in pairs and spaced by two separating bushings (26) as those previously mentioned. The rotation of the rotating joint (4) is transmitted by the main supply shaft (12) through the press-fitting generated between the outer diameter therefrom upon coupling onto the inner diameter of the tubular shaft (51). In this manner, the main supply shaft (12) jointly rotates with the tubular shaft (51) and this in turn is fitted against the inner tracks of the two ball bearings (24) onto which said tubular shaft (51) is likewise press-fitted.

In addition, the outer tracks of the ball bearings (24) are likewise press-fitted onto a common mortise created between the two lower and upper bodies (28-29) and with the peculiarity that, in order to make the assembly of the first rotating joint (4) more compact, the upper ball bearing of ball bearings (24) has been arranged and fitted onto both bodies (28-29).

The second rotating joint (5) has been designed to supply the liquid fluid (injected material) to the injecting pistol (53). It concerns a rotating joint (5) with one air passageway and it is basically composed of two cylindrical bodies, one upper body (38) and one lower body (37), screwed therebetween, while housing different elements designed to provide said second rotating joint (5) with rotation capacity and airtightness.

The upper body (38) is provided with a threaded bore (38*a*) in the upper area to feed the liquid fluid to an upper chamber provided there, housing therein a ceramic tube (31) acting as passageway of said fluid and connecting with a coupling (30) fixed through a castellated nut (33), threading said coupling (30) onto the upper end of the main supply shaft (12); such that through its inner bore the passing of fluid is facilitated to the lower end where it is assembled with the rod-holder crossbar (17), and, by means of a connecting coupling located therein, the liquid material injected through a sleeve is transferred towards the injecting pistol (53).

The airtightness of the different chambers of the second rotating joint (5) is obtained by including three retainers (35), one intended for making the upper chamber hermetic and two for isolating the second lower chamber composed of four bores at 90°, intended for drainage and refrigeration.

The rotation of the second rotating joint (5) is transmitted by the main supply shaft (12) via a coupling (30), which rotates jointly with the ceramic tube (31) and with the inner track of a ball bearing (32), being the outer track of the latter press-fitted onto the inner diameter of the cylindrical bodies: upper (38) and lower (37); thus achieving greater strength in the assembly of the second rotating joint (5).

In addition, a first separating bushing (36) is arranged onto this second rotating joint (5) to define the cavity created in the drainage chamber between the retainers (35), and also a second separating bushing (34), the function of which is to enable a chamber created between the lowest retainer (35) and the ball bearing (32) to house the castellated nut (33), which is in charge of fixing the second rotating joint (5) to the main supply shaft (12) through the coupling (30) it blocks.

The lifting device (3) is basically disposed onto three elements, two of which are movable (40), (41) and one is fixed (39). The two movable elements are screwed therebetween and arranged therebetween at 90°, such that one of them is vertically arranged, the one called head-holder support (41), whereas the head base support (40) is horizontally arranged, being the whole mechanism related to the application of liquid of the head on top of it.

The base support (40) of the lifting device (3) is screwed and arranged at 90° onto the head-holder support (41), such that when the first of them is lifted, the second is displaced vertically, thus displacing the entire device for the application of liquid (2) vertically, modifying the height with respect to the work table (52) of the machine where it is inserted.

The head-holder support (41) is provided with two slots where two linear guides (44) are screwed. The up/down vertical movement of the head-holder support (41) is carried out by displacing the two guides (44) through four linear bearings (43) that are fixed on two mortises provided in the main fixed support (39).

To perform the lifting of the entire device for the application of liquid (2), a pneumatic cylinder (54) has been provided, screwed and embedded on a mortise designed for such purpose and which is located on the rear surface of the main fixed support (39). When the pneumatic cylinder (54) is provided with pressure air, the stem of the latter pushes the base support (40) displacing the entire device for the application of liquid (2) vertically.

To allow for slightly adapting the height manually and for the pushing of the cylinder's (54) stem to be more uniform, a stem support (45) has been provided fixed to the base support (40) of the head and in the interior of which the stem of the cylinder (54) is housed, which in turn has been extended, an extender bushing (46) provided with two flat sides being coupled thereto. By rotating the extender bushing (46) through a fixed wrench it is possible to achieve a slight up/down displacement of the device for the application of liquid (2), thus allowing for a fine adjustment of the height of the injecting pistol (53) with respect to the work table (52) of a machine (55). The main fixed support (39) includes four perforations (39*a*) to fix the entire concentric head of different shapes to the machine where it is to be inserted.

Finally, among the main features to be highlighted is that the programmable concentric head for the application of liquid in lids of different shapes is versatile and, therefore, easily adapted to machines of the Penalver design, as well as to other machines made by other manufacturers, since it entails a compact head, is highly durable, requires minimum space, is highly productive, requires minimum maintenance, is capable of simply and easily exchanging different lid formats, and is capable of working with lids of different geometries with a wide array of sizes and with diverse features for sign-writing/tracing text, among others.

The invention claimed is:

1. A programmable concentric head for an application of a liquid fluid to peripheral areas of lids of different shapes comprising:

pistols for injecting said liquid fluid that are related to movable mechanisms that move the pistols through said peripheral areas of the lids, wherein said movable mechanisms are included in a device for the application of the liquid fluid and supported on a base support that is part of a lifting device, and wherein:

the movable mechanisms comprise an articulated mechanical device combined with two coaxial tubular shafts: a main supply shaft and a lower shaft, wherein a lower end of the main supply shaft is connected to a first part of the articulated mechanical device, while a second part of the articulated mechanical device is connected to a lower end of the lower shaft, the lower shaft and the main supply shaft rotate independently via transmission devices, and the main supply shaft is arranged in an inner hole of the lower shaft, which is arranged coaxially around at least one section of the main supply shaft.

2. The programmable concentric head according to claim 1, wherein:

the articulated mechanical device comprises a lower rod-holder crossbar combined with an upper rod-holder crossbar, wherein diametrically opposed ends of the lower rod-holder crossbar and the upper rod-holder crossbar are connected in an articulated manner via a first pair of rods and a second pair of rods, ends of the first pair of rods are connected to ends of the lower rod-holder crossbar, while ends of the second pair of rods are connected to ends of the upper rod-holder crossbar, common ends of the first pair of rods and the second pair of rods are coupled to each other via articulated connections, the pistols being arranged in contact therewith, the lower rod-holder crossbar is fixed through its center to the main supply shaft, while the upper rod-holder crossbar is fixed through its center to the lower shaft; wherein the lower rod-holder crossbar and the upper rod-holder crossbar are arranged in different parallel planes which are perpendicular to the direction of the two coaxial tubular shafts.

3. The programmable concentric head according to claim 2, wherein the articulated connections of the first pair of rods to the lower rod-holder crossbar and the second pair of rods to the upper rod-holder crossbar, comprise screws fixed to the first pair of rods and the second pair of rods, bearings spaced from each other by separating bushings being coupled around said screws; wherein the screws rotate jointly with an inner track of the bearings at the same time that outer tracks of the bearings are coupled to crossbar mortises; and wherein the first pair of rods and the second pair of rods and respective ones of the jointly fixed screws rotate as a block with respect to the diametrically opposed ends of the lower rod-holder crossbar and the upper rod-holder crossbar.

4. The programmable concentric head according to claim 2, wherein housings are created in the common ends of the articulated connection of the first pair of rods and the second pair of rods, each of the housings having a friction bushing press-fitted onto a first rod of the first pair of rods and a self-lubricated bronze bushing press-fitted onto the inner diameter of a second rod of the second pair of rods, and wherein the bronze bushing rotates around the friction bushing, thus allowing rotation between each of the first pair of rods and the second pair of rods through their articulated connections.

5. The programmable concentric head according to claim 2, wherein the pistols are fixed to the first pair of rods.

6. The programmable concentric head according to claim 1, further comprising two transmissions driven by two servomotors: a front servomotor and a rear servomotor, wherein:

the front servomotor transmits movement to an upper shaft of a tubular structure which is arranged in an axial direction of the lower shaft and above the lower shaft, and the rear servomotor transmits movement to the lower shaft, wherein the pistols are pneumatically-actuated and a supply of pressurized air and the liquid fluid to the pistols is carried out via the main supply shaft which rotates jointly with the upper shaft to which the main supply shaft is attached.

7. The programmable concentric head according to claim 6, wherein:

each of the transmissions is composed of two belts: a front belt and a rear belt, two driving pulleys: a front driving pulley and a rear driving pulley, and two driven pulleys: a front driven pulley and a rear driven pulley, on the transmission driven by the front servomotor, the front driven pulley rigidly rotates with the upper shaft of the tubular structure, the upper shaft being coupled to an inner diameter of the front driven pulley and fixed thereto by means of a conical bushing and a castellated nut, the upper shaft rotating jointly on inner tracks of two ball bearings which are arranged coupled onto a common mortise located on a front bearing support, and on the transmission actuated by the rear servomotor, the rear driven pulley rotates rigidly secured to the lower shaft, the lower shaft being coupled to an inner diameter of the rear driven pulley and fixed thereto by means of a conical bushing and a castellated nut, the lower shaft rotating jointly on inner tracks of two ball bearings, which are arranged coupled onto a common mortise located on a rear bearing support.

8. The programmable concentric head according to claim 6, wherein:

symmetrically, the front bearing support and the rear bearing support are screwed by means of four screws that fix the front bearing support and the rear bearing support onto the base support, and the main supply shaft is coupled onto a flange of the upper shaft and throughout its inner diameter, which constitutes a way to supply the pressurized air and the liquid fluid to the pistols, and said main supply shaft rotates jointly with the upper shaft to which the main supply shaft is attached.

9. The programmable concentric head according to claim 1, wherein the programmable concentric head additionally comprises a first rotating joint to supply pressurized air and a second rotating joint for the passage of the liquid fluid:

the first rotating joint comprises two air passageways and is composed of two cylindrical bodies: one upper body and one lower body screwed to the one upper body, and includes different elements to provide rotation capacity and airtightness, the lower body contains two inlets defined by two threaded bores for pressurized air inlets for handling the opening/closure of the pistols, wherein the pistols are pneumatically-actuated, and the second rotating joint drives the liquid fluid towards the pistols, and comprises an air passageway, composed of two cylindrical bodies: one upper body and one lower body screwed to the one upper body, and includes different elements to provide said second rotating joint with rotation capacity and airtightness.

10. The programmable concentric head according to claim 9, wherein:

the pressurized air passes from the two inlets of the lower body of the first rotating joint towards two separating bushings and two friction bushings respectively drilled, to thus connect to two ducts on which two tubes have been placed, the two tubes coupled around the main supply shaft, thus extending the two ducts to the lower end thereof, at a point where a first part of the articulated mechanical device is assembled for transferring the pressurized air by means of sleeves towards the pistols.

11. The programmable concentric head according to claim 10, wherein:

the airtightness of two chambers created inside the first rotating joint for the passing of the pressurized air includes four retainers arranged in pairs and separated by two separating bushings, the rotation of the first rotating joint is transmitted by the main supply shaft through a press-fitting located between an outer diameter of the main supply shaft upon coupling with an inner diameter of a tubular shaft; the main supply shaft rotating jointly with the tubular shaft and, in turn, both the main supply shaft and the tubular shaft rotating with inner tracks of two ball bearings onto which the tubular shaft is likewise press-fitted, and outer tracks of the ball bearings are press-fitted onto a common mortise created between the lower body and the upper body of the first rotating joint, and in order to make an assembly of the first rotating joint more compact, the two ball bearings have been arranged fitted onto the lower body and the upper body of the first rotating joint.

12. The programmable concentric head according to claim 9, wherein: the upper body of the second rotating joint is provided with a threaded bore in an upper area to feed the liquid fluid onto an upper chamber provided, housing therein a ceramic tube as a passageway for said liquid fluid and connecting with a coupling fixed through a castellated nut, threading said coupling onto an upper end of the main supply shaft; and through an inner bore the passing of the liquid fluid is facilitated towards a lower end of the main supply shaft where a first part of the articulated mechanical device is fixed for transferring the liquid fluid injected through sleeves towards the pistols.

13. The programmable concentric head according to claim 12, wherein:

the airtightness of different chambers of the second rotating joint is obtained by including three retainers, one for making an upper chamber hermetic and two for isolating a second lower chamber composed of four bores at 90°, for drainage and refrigeration, wherein the rotation of the second rotating joint is transmitted by the main supply shaft by means of a coupling, which rotates jointly with the ceramic tube and the inner track of a ball bearing;

an outer track of the ball bearing being press-fitted onto an inner diameter of an upper cylindrical body and a lower cylindrical body, a first separating bushing arranged on the second rotating joint, to define a cavity created in the second lower chamber between the three retainers and a second separating bushing to enable a chamber created between a lowest retainer and the ball bearing to house the castellated nut, which fixes the second rotating joint to the main supply shaft through the coupling.

14. The programmable concentric head according to claim 1, wherein the lifting device comprises a main fixed support coupled to a pneumatic cylinder, wherein a stem of the pneumatic cylinder is joined to the base support that supports an assembly of the lifting device for the application of the liquid fluid, and the base support is joined to a head-holder support.

15. The programmable concentric head according to claim 14, wherein the head-holder support includes two slots to which two linear guides are screwed, the two linear guides are connected to linear bearings which remain fixed on two mortises provided in the main fixed support.

16. The programmable concentric head according to claim 15, wherein the base support has a height regulation on its connection to the stem of the pneumatic cylinder, comprising a stem support fixed to the base support and housed in an interior of the stem of the pneumatic cylinder, and wherein an extender bushing is provided with two flat sides and is coupled thereto.

* * * * *